United States Patent [19]

Townsend

[11] Patent Number: 4,703,793

[45] Date of Patent: Nov. 3, 1987

[54] MINIMIZING COKE BUILDUP IN TRANSFER LINE HEAT EXCHANGERS

[75] Inventor: Robert W. Townsend, Waianae, Hi.

[73] Assignee: Sante Fe Braun Inc., Alhambra, Calif.

[21] Appl. No.: 874,211

[22] Filed: Jun. 13, 1986

[51] Int. Cl.[4] ..... F28F 19/00

[52] U.S. Cl. ..... 165/1; 165/134.1; 165/95; 165/907; 134/22.11; 201/2

[58] Field of Search ..... 165/1, 134.1, 95, 907; 134/22.11; 201/2

[56] References Cited

U.S. PATENT DOCUMENTS

| | | | |
|---|---|---|---|
| 3,416,598 | 12/1968 | Dozn | 201/2 X |
| 4,097,544 | 6/1978 | Hengstebeck | 165/134.1 X |
| 4,366,003 | 12/1982 | Kozte et al. | 165/95 X |
| 4,551,181 | 11/1985 | Stearman | 134/22.11 |

*Primary Examiner*—Albert W. Davis, Jr.
*Assistant Examiner*—Richard R. Cole
*Attorney, Agent, or Firm*—Lyon & Lyon

[57] ABSTRACT

Shell-and-tube transfer line heat exchangers having heat exchange tubes contained within an outer shell and a primary tubesheet, to minimize inlet end fouling, are disclosed. The exchanger includes: a secondary porous tubesheet, through which a reactive gas, e.g., an oxidizing gas such as air, oxygen, steam or mixtures thereof or a reducing gas such as hydrogen, carbon monoxide or mixtures thereof, can diffuse in amounts sufficient to react with coke deposits on the porous tubesheets process gas inlet side; the porous tubesheet is positioned preferably, but not necessarily, substantially parallel to the heat exchanger's process gas inlet end primary tubesheet nearer the inlet ends of the heat exchange tubes than the primary tubesheet and is, like the primary tubesheet, perforated by the heat exchange tubes, thus creating, with the heat exchanger's outer shell and the primary tubesheet, an enclosed space, and at least one gas inlet communicating with the enclosed space through which the reactive gas is fed. Methods of quenching high temperature gases while recovering useable heat therefrom using these transfer line heat exchangers are also disclosed.

16 Claims, 2 Drawing Figures

MINIMIZING COKE BUILDUP IN TRANSFER LINE HEAT EXCHANGERS

FIELD OF THE INVENTION

This invention relates to novel heat exchangers and to chemical processes involving their use. More particularly, this invention relates to new and improved indirect shell-and-tube heat exchangers of the type known as transfer line heat exchangers (TLEs), and to improved processes of quenching or recovering heat from high temperature fluids, and particularly high temperature gases, which involve their use. These novel TLEs are modified at their inlet ends in comparison to conventional TLEs by means which when employed together with a gas reactive with coke deposits, minimize or prevent inlet end fouling. Such fouling commonly occurs in conventional TLEs due to coke buildup resulting from condensation or precipitation, and then decomposition by ambient heat, of tars, high polymers or other high molecular weight materials during processing.

BACKGROUND OF THE INVENTION

Shell-and-tube transfer line heat exchangers are in widespread use in commercial chemical processing. In general, they operate to cool hot gases by passing these gases through a bundle of tubes in heat exchange relationship with a cooling fluid, such as water, passing around the outside, or shell side, of the tubes and contained within a defined area by means of a pair of tubesheets which are generally perpendicular to the tubes contained within them. In certain processes, the heat removed from the process gas is sufficient to vaporize the fluid on the shell side. In such cases if water is used as the cooling fluid the heat exchanger also becomes a steam generator.

TLEs are commonly used to cool very hot process gases. For example, they are used in processes for producing ammonia such as that disclosed in U.S. Pat. No. 3,442,613, issued May 6, 1969 to Grotz, to cool the approximately 850° F. ammonia-containing gas exiting a syngas converter. They are also used in olefin plants and in other hydrocarbon cracking operations to recover usable heat from reactor gases, e.g., gases resulting from the cracking of ethane, propane, butane or mixtures thereof exiting pyrolysis furnace coils at temperatures above 1500° F. To avoid secondary reactions leading to less valuable or useless products, the residence time spent by the exiting gases between the furnace coil outlet and the TLE inlet should be minimized. The pressure drop across the TLE should also be minimized, since cracking selectivity towards more useful products in the furnace is directly dependent on cracking-coil outlet pressure, and ordinarily a pressure rise of no more than a few p.s.i. at the furnace outlet is all that can be tolerated if process stability is to be maintained. A discussion of various TLE designs is found in Albright et al, "Pyrolysis Theory and Industrial Practice" (New York: Academic Press, 1983), Chapter 18.

The efficiency with which heat is recovered by a TLE can have a marked effect on plant operating costs. Inlet end fouling due to coke buildup can impair this efficiency to a substantial extent. At higher temperatures in processes where coking is a problem, very hard and often refractory layers of coke or carbon can form on the walls of the reactor, conduits and heat exchangers. This coke buildup will cause an increase in pressure drop across the TLE, which is detrimental to cracking yields and eventually requires a shutdown of the equipment to permit decoking.

It is difficult to examine in detail all of the reaction mechanisms occurring in chemical processes carried out at extremely high temperatures. Consequently, the mechanism(s) responsible for coke buildup in processes involving the use of TLEs have never been entirely elucidated. Some believe that it is important to keep the TLE tubes at a temperature above the dew point of any materials present which have a tendency to coke or deposit; see U.S. Pat. No. 4,405,440, issued Sept. 20, 1983 to Gwyn. Others believe it to be important to keep the connector between the reactor and the TLE at a temperature below 450° C., well below that of the exiting gas stream, on the theory that if a gas stream, e.g., one flowing at a mass velocity below 50 kg/m$^2$ per second, is quickly cooled to a temperature well below the temperature at the reactor exit, coking will not occur; see U.S. Pat. No. 4,151,217, issued Apr. 24, 1979 to Amano et al, and U.S. Pat. No. 4,384,160, issued May 17, 1983 to Skraba.

Other prior art methods of ameliorating the coking problem or attempting to prevent coking from occurring altogether have generally fallen into one of three categories:

prevention of coke buildup by means of substances added to the gas stream (see U.S. Pat. Nos. 3,174,924, issued Mar. 23, 1965 to Clark et al; 4,097,544, issued June 27, 1978 to Hengstebeck, and the Skraba patent, each of which discloses injecting a quench fluid or fluids into the gas stream being cooled) or added to the TLE tubes themselves (see U.S. Pat. Nos. 3,073,875, issued Jan. 15, 1963 to Braconier et al and 4,288,408, issued Sept. 8, 1981 to Guth et al, which disclose methods of forming a liquid or a gas film on the inner surfaces of the reactor, the tubes or both);

mechanical or chemical/mechanical means for cleaning out coke deposits once formed; see U.S. Pat. No. 4,248,834, issued Feb. 3, 1981 to Tokumitsu, which discloses decoking by feeding air through the system after interrupting the gas stream exiting the reactor, and U.S. Pat. No. 4,366,003, issued Dec. 28, 1982 to Korte et al, which discloses the use of high speed gas streams delivered from jet nozzles positioned above the TLE inlet openings to periodically flush the inlets clean, and various mechanical modifications of the TLEs or surrounding equipment, such as the use of an inlet screen or sieve medium disposed in the inlet portion of the TLE at an easily accessible portion thereof to cause coke to build up on the screen or sieve; coke is removed by removing the used screen or sieve (U.S. Pat. No. 3,880,621, issued Apr. 29, 1975 to Schneider et al), varying tube size to equalize flow through each of the TLE tubes (U.S. Pat. No. 4,397,740, issued Aug. 9, 1983 to Koontz), "insulating" the tubes with heat transfer medium which is thinner at the inlet end and increases in thickness gradually or uniformly to a point at or near the end of the tubes (the Gwyn patent), using an expansion section and conduits to inject water to form a steam sheath adjacent to the walls of the expansion section (U.S. Pat. No. 3,574,781, issued Feb. 14, 1968 to Racine et al), using a precooler closely followed by a pair of aftercoolers connected in parallel (U.S. Pat. No. 3,607,153, issued Sept. 21, 1971 to Cijer), connecting a conically ended heat exchanger directly to a cracking heater outlet (U.S. Pat. No. 3,456,719, issued July 22, 1969 to Palchik), and using a bundle of triple tubes (U.S. Pat. No. 3,903,963, issued Sept. 9, 1975 to Fuki et al).

None of these expedients has fully served the intended purpose, and coking at TLE inlet ends remains a significant problem to the involved segments of the chemical processing industry.

One successful solution to this problem is disclosed and claimed in U.S. patent application entitled "Flow Streamlining Device For Transfer Line Heat Exchangers", Ser. No. 864,018, filed May 16, 1986 in the name of Carlton K. Shen-Tu and of common assignment with this application.

There has now been discovered another combination of expedients which minimizes or prevents entirely TLE inlet end fouling by coke buildup during high temperature chemical processing, and thus minimizes increased pressure drop across the system. This in turn optimizes heat recovery, process dynamics and process stability, and permits longer process runs between shutdowns.

It is, therefore, an object of this invention to provide novel transfer line heat exchangers.

Another object of this invention is to provide improved processes of quenching or recovering heat from high temperature fluids, and particularly high temperature gases, which involve the use of my novel transfer line heat exchangers.

A further object of this invention is to provide novel transfer line heat exchangers modified at their inlet ends by means which when employed together with a gas reactive with coke deposits, minimize or prevent inlet end fouling due to coke buildup.

These and other objects, as well as the nature, scope and utilization of this invention, will become readily apparent to those skilled in the art from the following description, the drawings and the appended claims.

SUMMARY OF THE INVENTION

Modification of the inlet end of a conventional TLE in accordance with this invention involves the following elements:

A secondary porous tubesheet through which a reactive gas can flow in amounts sufficient to react with coke deposits on the process gas inlet side of the porous tubesheet. This porous tubesheet is positioned preferably but not necessarily substantially parallel to the primary tubesheet, nearer the inlet ends of the TLE's tubes than the primary tubesheet and, like the primary tubesheet, is perforated by the TLE's tubes. Thus, the porous tubesheet creates with the outer shell of the TLE an enclosed space between itself and the primary tubesheet.

At least one gas inlet communicating with the enclosed space created by the outer shell of the TLE, the primary tubesheet and the secondary porous tubesheet. The gas inlet(s) are used to feed into the enclosed space one or a mixture of gases reactive with coke deposits generated by the particular process gas being cooled. The reactive gas flows through the secondary, porous tubesheet to its process gas inlet side where such coke deposits have formed and reacts with the coke. The gaseous products of such reactions then pass with the process gas through the TLE.

DETAILED DESCRIPTION OF THE INVENTION

I do not wish to be bound by any particular mechanism or theory advanced to explain the mode of operation of my invention, the advantages obtainable therefrom, or the mechanism(s) of chemical reactions, physical phenomena or combinations thereof occurring in TLEs modified in accordance with the invention at their inlet ends situated at or near the exit of a chemical reactor generating a stream of high temperature gas. I believe, however, that TLE inlet end fouling by coke deposit formation is chiefly due to at least one and possibly three distinct mechanisms, each of which can contribute to slow cooling at and in the vicinity of the TLE inlet end, a condition believed to be conducive to coke deposition.

First, solid coke particles entrained in the entering gases can impact on TLE surfaces, particularly surfaces perpendicular to the direction of the gas flow, and progressively build up deposits on these surfaces. Ultimately, such deposits can block the inlet ends of the TLE tubes by "scaffolding" or cantilevering across the tube openings.

Second, nonideal gas flow distribution in the TLE at its inlet and beyond, and on the hot tubesheet, can cause turbulent eddies and backmixing of the gases present, cooling them to also result in increased fouling.

Third, coke and pyrolysis tars, and other condensible or precipitatible materials, can condense or deposit on any surface of the TLE or adjacent equipment which has been allowed to cool to below the dew point of the condensing or depositing material.

In hitherto commonly used TLEs, the ratio of total tube inlet area to flat surface area on the surrounding tubesheet can be quite small. A typical TLE may have less than 20% of the total surface area of its tubesheet perforated with heat exchange tube inlets; see, for example, the Fuki et al, Hengstebeck and Koontz patents. Whatever portion of the flat surface area on the tubesheet not perforated by heat exchange tube inlets becomes an impact surface, one which is normally comparatively cool by virtue of contact with heat exchange fluid on its underside and thus one which can give rise to coke deposits by any or all of the above-mentioned mechanisms.

Figure 1:
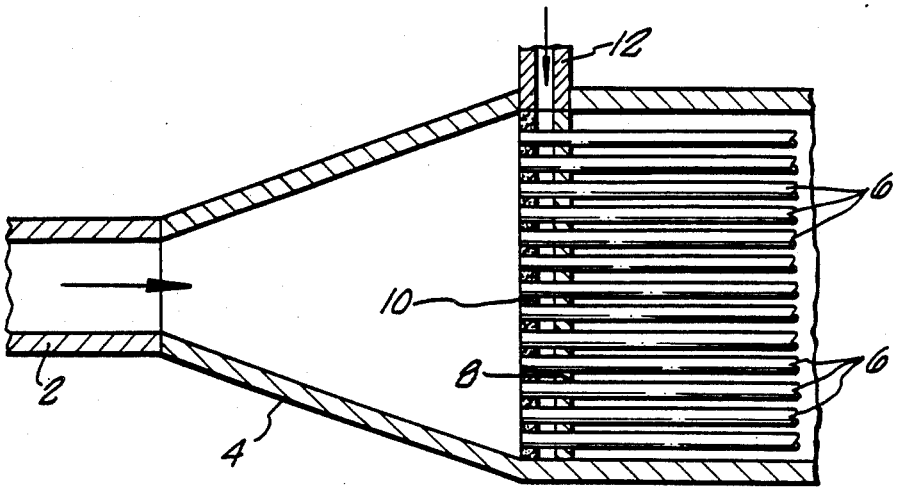
FIG. 1 is a cross-sectional view of a conventional TLE inlet end modified in accordance with the invention.

Considering now the present invention and its use in minimizing or preventing TLE inlet end fouling, with reference to the accompanying drawings:

As illustrated in FIG. 1 a TLE 1 modified in accordance with this invention will have a transfer line 2 connecting the exit of a chemical reactor (not shown; e.g., a hydrocarbon pyrolysis furnace) generating a stream of high temperature process gas, with an inlet section 4, preferably although not necessarily cone shaped, through which the process gas is directed into the TLE tubes 6. The tubes 6 are held in place by an inlet end (primary) tubesheet 8 and an outlet end tubesheet (not shown), and are contained within an outer shell 10. Cooling (heat exchange) fluid is circulated (by means not shown) through the area contained between the inlet end and outlet end tubesheets and the outer shell 10 and around the outside, or shell side, of the tubes 6 which pass therethrough, to effect heat exchange between this fluid and the hot process gases being passed through the tubes 6.

A secondary, porous tubesheet 12 is positioned on the process gas inlet side of the inlet end (primary) tubesheet 8, preferably but not necessarily substantially parallel to the primary tubesheet 8, and nearer the inlet ends of the tubes 6 than the primary tubesheet 8. This porous tubesheet 12 is, like the primary tubesheet 8, perforated by the tubes 6 and creates, with the outer shell 10 of the TLE, an enclosed space 14 between itself and the primary tubesheet 8.

The enclosed space 14 can range in width (as measured along the tubes 6) from the interstices that result when the porous tubesheet 12 just abuts the primary tubesheet 8 to a width of about two inches or more, and any width sufficient to permit reactive gas to be fed in amounts sufficient to accomplish decoking at the process gas inlet side of the porous tubesheet 12 can be employed.

The porous tubesheet 12 can be made of any material suitable for use in a TLE including, but not limited to, ceramic materials, sintered steel alloys or other metals, or the like, with the choice of materials being dictated by such factors as cost, the conditions (exiting gas temperature, reactor pressure, composition of the gas being quenched, etc.) of the chemical process being carried out, the rate of coke deposition, the degree of porosity desired, and the like.

Figure 2:
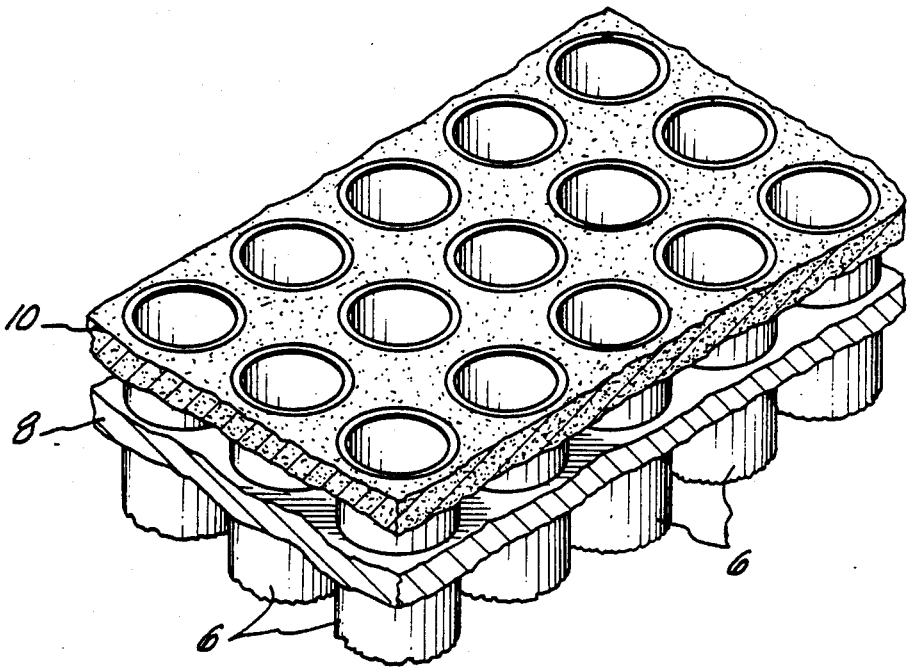
FIG. 2 is a plan view of a conventional TLE inlet end illustrating in greater detail one of the modifications—the secondary, porous tubesheet—of the present invention.

FIG. 2 illustrates in greater detail one embodiment of the spatial relationship between a porous tubesheet 12, a primary tubesheet 8 and the tubes 6, which gives rise to an enclosed space 14.

Returning now to FIG. 1, a gas inlet 16 communicates with the enclosed space 14. One or more gas inlets 16 can be employed to feed into the enclosed space 14 at a desired rate, continuously or intermittently, using metering means or any other suitable means (not shown), a gas or a mixture of gases reactive with coke deposits generated by the particular process gas being cooled. Means for delivery of reactive gas at pressures ranging from about 1 to about 100 psi above process gas pressure, to aid in the passage of the reactive gas through the porous tubesheet 12, can be provided.

Any gas reactive with the coke deposits generated by the process gas exiting the reactor can be employed, including but not limited to oxidizing gases such as air, oxygen, steam, or the like, and mixtures thereof, and reducing gases such as hydrogen, carbon monoxide, or the like, and mixtures thereof. If one reactive gas or gas mixture fails to remove all or a substantial amount of the coke deposited, a different reactive gas or gases can then be fed to the enclosed space 14 to further react with the coke. The reactive gas will flow through the porous tubesheet 12 to its process gas inlet side and react there with coke deposits. The gaseous products of such reactions will then pass with the process gas through the TLE.

The rate of coke deposition on the process gas inlet side of the porous tubesheet 12 will normally be slow enough so that the volume of reactive gas employed will be minimal compared to the volume of process gas entering the TLE. Consequently, contamination of the process gas by the reactive gas, e.g., by nitrogen when air is the reactive gas, and by its gaseous reaction products with coke will be negligible.

As can be seen from the foregoing description, the porous tubesheet 12 moderates the flow of reactive gas to the TLE inlet cone 4. In other words, instead of this gas immediately entering the inlet cone 4, where it would react with the process gas as well as with coke deposits, the reactive gas initially flows through the porous tubesheet 12 and first contacts coke deposits on the tubesheet's process gas inlet side. Only after this will any unreacted reactive gas contact the process gas.

The above discussion of this invention is directed primarily to preferred embodiments and practices thereof. It will be readily apparent to those skilled in the art that further changes and modifications in the actual implementation of the concepts described herein can readily be made without departing from the spirit and scope of the invention as defined by the following claims.

I claim:

1. In a method of quenching high temperature gases while recovering useable heat therefrom by means of a shell-and-tube transfer line heat exchanger having heat exchange tubes contained within an outer shell and a primary tubesheet, the improvement comprising:

(A) passing high temperature process gas into a heat exchanger to minimize inlet end fouling, which comprises:

(1) a secondary porous tubesheet positioned on the process gas inlet end of the heat exchanger, through which a reactive gas can flow in amounts sufficient to react with coke deposits on the porous tubesheet's process gas inlet side, and (2) at least one gas inlet communicating with the enclosed space created by the porous tubesheet, the outer shell and the primary tubesheet; and (B) feeding a reactive gas through the gas inlet or inlets to flow through the porous tubesheet and react with coke deposits on the porous tubesheet's process gas inlet side.

2. A method as recited in claim 1 wherein the porous tubesheet is made of a ceramic material.

3. A method as recited in claim 1 wherein the porous tubesheet is made of sintered metal.

4. A method as recited in claim 3 wherein the sintered metal is a steel alloy.

5. A method as recited in claim 1 wherein the reactive gas is an oxidizing gas.

6. A method as recited in claim 5 wherein the oxidizing gas is air, oxygen, steam or mixtures thereof.

7. A method as recited in claim 1 wherein the reactive gas is a reducing gas.

8. A method as recited in claim 7 wherein the reducing gas is hydrogen, carbon monoxide or mixtures thereof.

9. A method of quenching high temperature gases while recovering useable heat therefrom by means of an indirect shell-and-tube transfer line heat exchanger having heat exchange tubes contained within an outer shell and a primary tubesheet, which comprises:

(A) passing high temperature process gas into a heat exchanger to minimize inlet end fouling, which comprises:

(1) a secondary porous tubesheet positioned on the process gas inlet end of the heat exchanger nearer the inlet end of the heat exchange tubes than the primary tubesheet, through which a reactive gas can flow in amounts sufficient to react with coke deposits on the porous tubesheets process gas inlet side, and (2) at least one gas inlet communicating with the enclosed space created by the porous tubesheet, the outer shell and the primary tubesheet; and (B) feeding a reactive gas through the gas inlet or inlets to flow through the porous tubesheet and react with coke deposits on the porous tubesheet's process gas inlet side.

10. A method as recited in claim 9 wherein the porous tubesheet is made of a ceramic material.

11. A method as recited in claim 9 wherein the porous tubesheet is made of sintered metal.

12. A method as recited in claim 11 wherein the sintered metal is a steel alloy.

13. A method as recited in claim 9 wherein the reactive gas is an oxidizing gas.

14. A method as recited in claim 13 wherein the oxidizing gas is air, oxygen, steam or mixtures thereof.

15. A method as recited in claim 9 wherein the reactive gas is a reducing gas.

16. A method as recited in claim 15 wherein the reducing gas is hydrogen, carbon monoxide or mixtures thereof.

* * * * *